United States Patent [19]

Nelson

[11] 4,060,723

[45] Nov. 29, 1977

[54] FLASHLIGHT ASSEMBLY

[75] Inventor: Norman C. Nelson, Barstow, Calif.

[73] Assignee: Kel-Lite Industries, Inc., Barstow, Calif.

[21] Appl. No.: 649,404

[22] Filed: Jan. 15, 1976

[51] Int. Cl.[2] ..... H01H 3/40; F21V 23/04

[52] U.S. Cl. ..... 362/205; 200/60

[58] Field of Search ..... 240/10.64, 10.65 D, 240/10.6 CH, 10.66, 10.6 R, 10.68; 200/60

[56] References Cited

U.S. PATENT DOCUMENTS

| | | | |
|---|---|---|---|
| 1,372,851 | 3/1921 | Vreeland | 240/10.66 |
| 2,309,402 | 1/1943 | Korngold | 200/60 |
| 2,564,612 | 8/1951 | Schneider | 200/60 |
| 2,779,832 | 1/1957 | Winters et al. | 200/60 |
| 2,818,498 | 12/1957 | Foch | 240/10.6 CH UX |
| 3,340,391 | 9/1967 | Heyden | 240/10.64 |
| 3,835,272 | 9/1974 | Wisenbaker | 200/60 |

FOREIGN PATENT DOCUMENTS

| | | | |
|---|---|---|---|
| 665,640 | 9/1938 | Germany | 240/10.6 |
| 232,100 | 4/1925 | United Kingdom | 200/60 |

*Primary Examiner*—Donald A. Griffin
*Attorney, Agent, or Firm*—Allan D. Mockabee

[57] ABSTRACT

A flashlight assembly including a cylindrical housing defining a battery compartment and a separated lamp compartment with a circuit controlling switch located entirely on the outside of the cylindrical enclosure, the lamp compartment lying in a separate part of the cylindrical enclosure which is threadedly connected to the main portion of the enclosure, there being an electrical connector between the switch unit and the lamp and socket unit which extends from the switch on the outside of the enclosure to the interior of the lamp compartment and remains entirely outside the battery compartment.

1 Claim, 7 Drawing Figures

FLASHLIGHT ASSEMBLY

This invention relates to a flashlight assembly of the type which includes an outer casing or housing which is adapted to contain one or more power cells or batteries and also a socket and lamp unit. This type of light includes switch mechanism for closing and opening an electrical circuit including the battery means and the lamp.

In the customary construction of flashlights at least part of the switch mechanism or a connection from the switch to the lamp and socket unit are located within the battery compartment of the casing or enclosure. Passage of time and the proximity of the switch or electrical connector parts to the batteries results in corrosion of the switch and connector elements due to the chemical properties of the batteries. This condition can considerably shorten the useful life of a flashlight.

The customary location of switch parts and connections inside the battery enclosure make it more difficult to assemble the devices and where it is necessary to replace or repair switch parts or the like, particularly in the more expensive types of flashlights for professional use, repair is much more difficult.

It is an object of the invention to provide a flashlight construction wherein the control switch contact elements, the connection between the switch and the lamp and the socket unit and the switch actuator are all located outside of the battery compartment and of course more particularly on the outside of the enclosure comprising the main body of the flashlight, thereby protecting those elements from the corrosive defects of gaseous chemicals confined in the battery compartment and also greatly facilitating initial assembly and repair of the switch mechanism.

Other objects and advantages will more fully appear from the following description in connection with the accompanying drawings.

Figure 1:
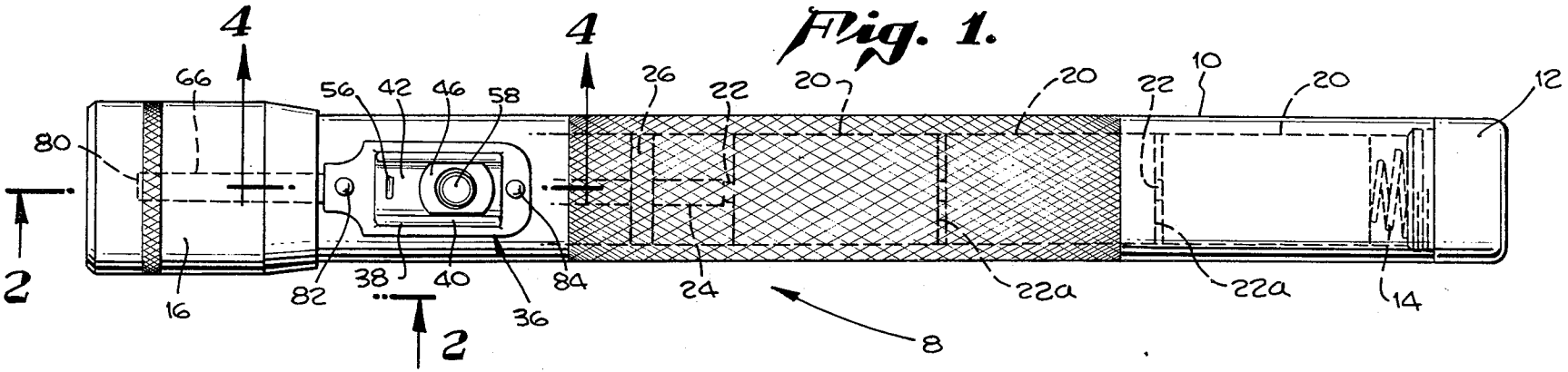
FIG. 1 is a plan view of an embodiment of the invention showing the batteries and other interior features in broken lines.
Figure 3:
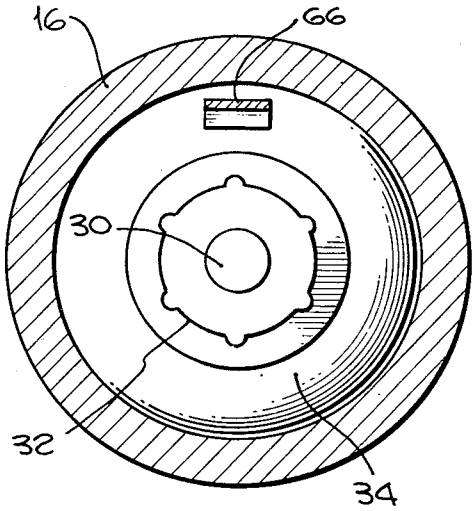
FIG. 3 is a section taken approximately on the line 3—3 of FIG. 2.
Figure 2:
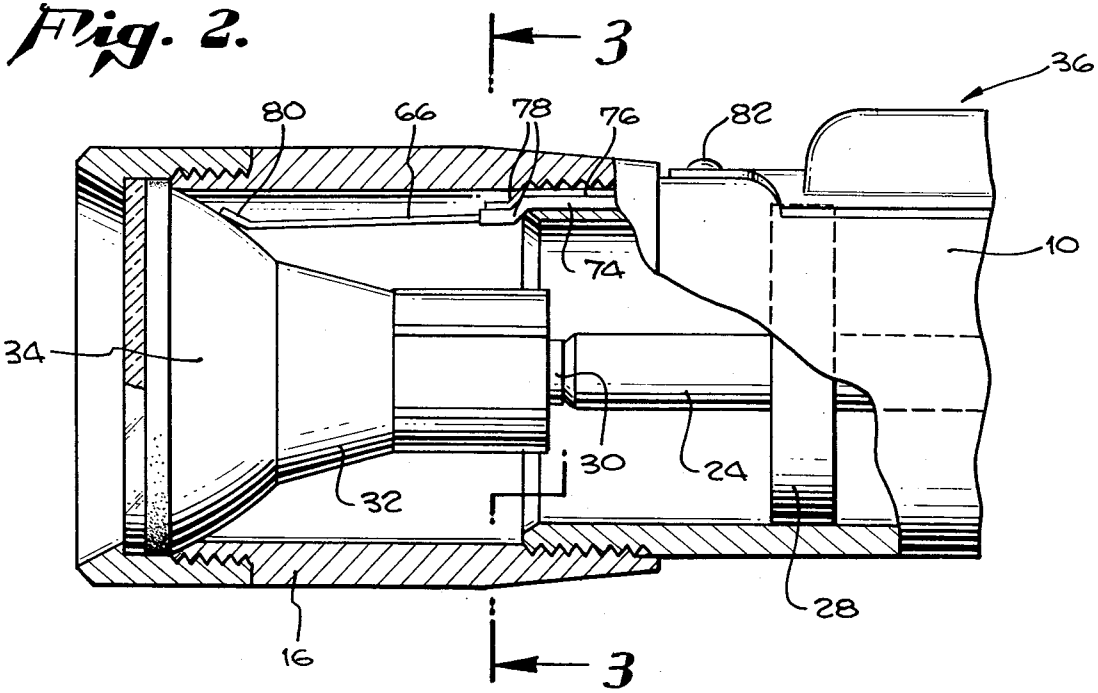
FIG. 2 is an enlarged sectional detail taken approximately or the line 2—2 of FIG. 1.

The flashlight illustrated in the drawings includes an enclosure generally indicated at 8 and including a main cylindrical section 10, a threaded rear end cap 12 carrying a compression spring 14 and a threaded forward end portion 16. The main central portion 10 is adapted to receive a series of dry batteries or power cells 20. Extending forwardly from the positive hole 22 of the forwardmost of the batteries 20 is an electrically conductive rod 24 which extends through and is supported by a pair of dielectric discs 26 and 28 which hold the rod 24 in a centered position in the enclosure. The forward end of rod 24 is in electrical engagement with a contact 30 which forms part of a lamp socket 32 having a metallic reflector portion 34. As is conventional in devices of this type the contact 30 and the conductive reflector 34 are electrically connected with complementary portions of a lamp base received in the socket, the lamp and its base being conventional and therefore not shown.

Located on the outside of the main section 10 of the cylindrical enclosure 8 is a switch housing 36 having a pair of spaced parallel upstanding side walls 38 bent over upon themselves as at 40 to provide a pair of laterally spaced thumb guides below and between which is a horizontal slide 42 having an elongated opening 44. A switch button 46 is slidable on the horizontal portion 42 of the housing. It extends downwardly through the elongated slot 44 and has mounted thereon, beneath the horizontal housing portion 42, a leaf spring 50. This leaf spring has upwardly struck detents 54 at opposite ends thereof to work in cooperation with downwardly struck detents 56 in the horizontal portion 42 of the housing 38.

A blinker button 58 extends downwardly through the switch button 46 and is adapted to reciprocate vertically therein within limits. An expansion spring 60 is located beneath the enlarged upper end of the blinker button 58 to bias said button upwardly. A lock ring 62 on the downwardly extending portion of the blinker button limits upward movement of said button.

The central portion 10 of the main housing 8 is provided with a longitudinal relief or groove 64 which extends from beneath the switch housing 36 forwardly to the extreme forward end of said central cylindrical portion 10 In this relief 64 lies a connector element 66 having at its rear end an electrical contact portion 68. Immediately in front of the contact portion 68 are two graduated stepped portions 70 and 72. Forwardly of the stepped portion 72 the connector element is bent down and then extends a considerable distance forwardly in a relatively flat condition. Most of this forwardly extending portion is covered with a suitable electrical insulating material 74. The connector 66 extends beyond the forward end of the central enclosure section 10 and into the threaded removable end enclosure section 16. A stabilzer spring 76 overlies the connector element 66 and the two are bent down as indicated at 78 with the bent end of the stabilizer part 76 holding the connector element 66 against undesirable upward bending and also holding it at its forward end 80 in electrical contact with the light reflector 34.

A suitable rivet 82 secures the connector element 66 and stabilizer bar 76 in the relief groove 64 in the cylindrical housing section 10 and also anchors the forward end of the switch housing 36 to the outside of the main body of the flashlight. The rear end of housing 36 is secured by a suitable rivet 84.

Figure 4:
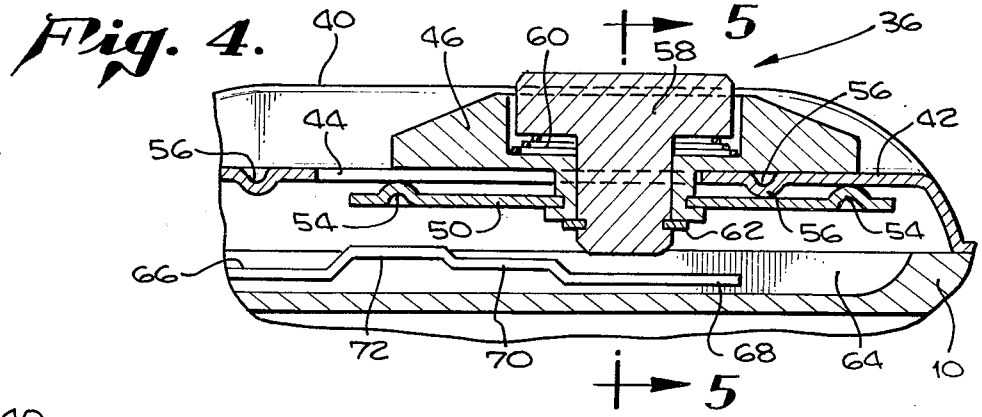
FIG. 4 is an enlarged sectional detail taken approximately on the line 4—4 of FIG. 1 and showing the switch in its off position.
Figure 5:
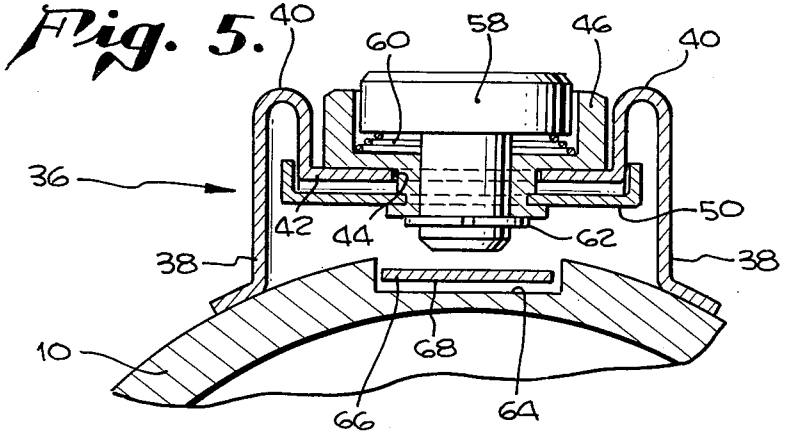
FIG. 5 is a section taken approximately on the line 5—5 of FIG. 4.
Figure 6:
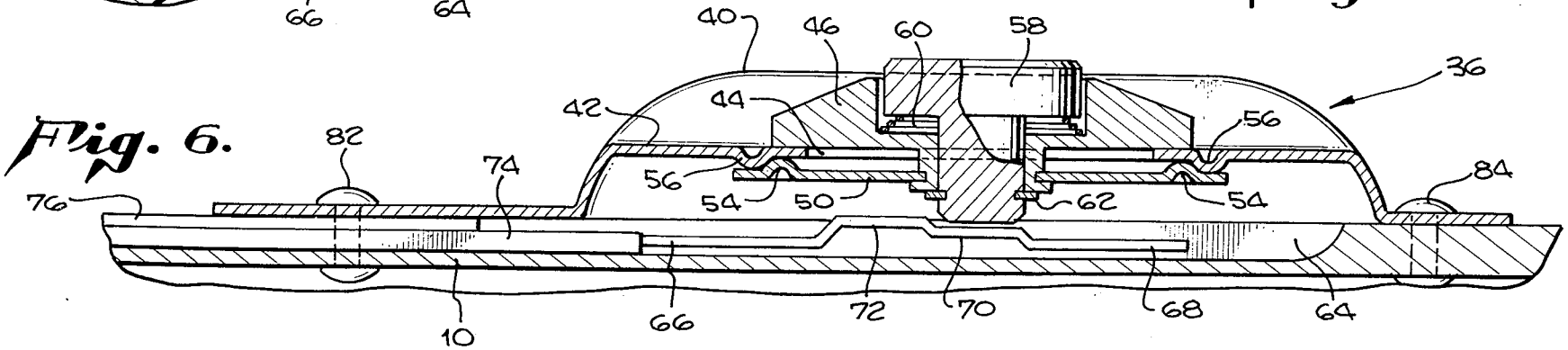
FIG. 6 is a section similar to that in FIG. 4 with the control switch in position permitting the flashlight to be "blinked" on and off with the thumb of the user.
Figure 7:
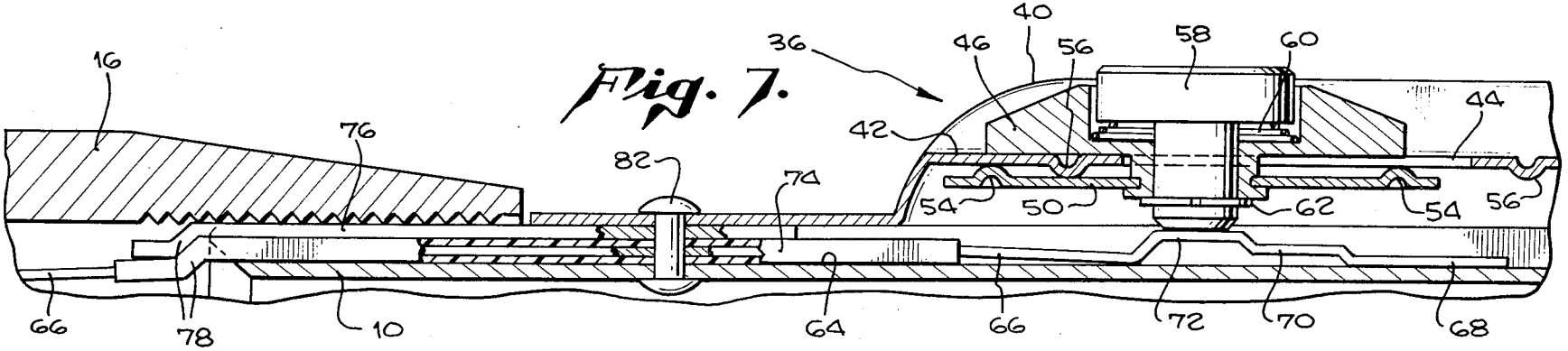
FIG. 7 is a sectional view similar to FIG. 6 with the control switch in the "on" position of the flashlight.

When the batteries are placed in the body of the flashlight as indicated in FIG. 1 they are in series with their central positive poles 22 in electrical contact with the negative rear ends **22*a* of the battery immediately in front thereof, except for the lead battery whose positive central pole 22 engages the rod 24 as mentioned above. The conductive end of the rear battery shown in FIG. 1 is in electrical contact with the spring 14 and the entire enclosure or main body of the flashlight is conductive and forms part of the circuit in a conventional manner. Thus when the blinker button 58 is depressed against the higher step 72 of the connector 66, it will cause the contact portion 68 of said connector to engage the metal of the flashlight enclosure 8 and a circuit will be made through said connector 66** to the light reflector 34 which forms part of the lamp socket 32. From the lamp socket the circuit is completed through the electrically conductive rod 24 which is in contact with the foremost battery positive terminal 22. Referring to FIGS. 4, 6 and 7, with the slidable switch member 46 in its rearmost position as in FIG. 4, depression of the switch button 58 to its fullest downward extent will not cause the contact portion 68 of the connector 66 to engage the bottom of the relief 64 and complete the circuit. When the slidable switch member 46 and button 58 are pushed forwardly to the position of FIG. 6 the rearward detent 54 in the leaf spring 50 will lie just in front of the rearward detent 56 of the horizontal portion 42 of the housing 36. The forward detent 54 lies just rearwardly of the forward detent 56. When the leaf spring 50 is held in this position, depression of the blinker button 58 will cause the connector 66 to flex downwardly bringing its contact portion 68 into engagement with the metal enclosure comprising the body of the flashlight and complete the circuit only so long as the button 58 is held in a depressed condition by the thumb of the user. The button 58 can be depressed and released in an intermittent series of movements to convey a signal in Morse Code or other prearrangement. When the switch element 46 and button 58 are pushed to their extreme forward position with the detents 54 of the leaf spring forwardly of the respective adjacent detents of the horizontal portion 42 of the housing, the higher stepped portion 72 of the connector is beneath the button 58 and the contact portion 68 of the connector 66 is held in contact with the main body of the flashlight to maintain the circuit closed until the button 46 is moved rearwardly.

From the above it will be seen that all of the switch mechanism of the flashlight and all of the connector element 66 including that portion thereof which comprises the contact portion 68 are located outside of the battery compartment of the flashlight. The batteries are located in the main or central section 18 of the enclosure and are separated from the forward portion thereof and from the lamp compartment in the forward end section 16 by the two longitudinally spaced dielectric discs 26 and 28 which support the conductive rod 24. The connector element 66 extends from the switch operating mechanism in the housing on the outside of the casing, along the longitudinal external relief 64 and into the lamp compartment of the forward end portion 16, entirely outside of the battery compartment. Even though there is not a positive seal between the battery compartment and the lamp compartment with the forward end of the connector 66 therein, the connector element is quite remote from the battery compartment and this distance from the batteries and the fact that they are actually in a separate compartment, protects the connector against corrosion. Clearly the elements of the switch assembly are not subjected to the corrosive action of the batteries because they are on the outside of the enclosure.

Another advantage of locating all the elements of the switch on the outside is that it is easier to assemble and also easier to repair. While some types of household flashlights are so inexpensive that repairs to the switch might not be economical, there are more expensive constructions, particularly those used professionally in many occupations including police work where properly operating and dependable flashlights are at times of extreme importance.

It should be understood that various changes can be made in the form, details, arrangement and proportions of the various parts without departing from the spirit of the invention.

I claim:

1. In an electric battery powered flashlight, a main body comprising an enclosure having a side wall with a battery compartment and a separated lamp compartment having a socket for a lamp, said main body incorporating portions of an electric circuit of which battery means in the battery compartment, the lamp socket and a lamp therein are parts, switch means in said circuit including contact means, one of which is movable relative to another to make and break said circuit, a connection for establishing said circuit between said switch means and one of said lamp and socket, said contact means being carried by said main body outside said battery compartment, said connection between said switch means and one of said lamp and socket means also being carried by the main body outside said battery compartment and extending into said lamp compartment, the main body enclosure being tubular and having first and second separable cylindrical sections, the first section having a male portion with threads and having a longitudinal relief through and deeper than the threads, said connection for establishing said circuit between said switch means and said one of said lamp and socket being located in said relief below the bottoms of said threads, and said second section having an opening with female threads therein and into which the male portion is threaded with said connection in the relief.

* * * * *